US009146030B2

(12) United States Patent
Stefanoff

(10) Patent No.: US 9,146,030 B2
(45) Date of Patent: Sep. 29, 2015

(54) LIGHT EMITTING DIODE (LED) LIGHTING ASSEMBLIES AND METHODS OF USE

(71) Applicant: Buddy Stefanoff, Owasso, OK (US)

(72) Inventor: Buddy Stefanoff, Owasso, OK (US)

( * ) Notice: Subject to any disclaimer, the term of this patent is extended or adjusted under 35 U.S.C. 154(b) by 282 days.

(21) Appl. No.: 13/921,062

(22) Filed: Jun. 18, 2013

(65) Prior Publication Data

US 2013/0335965 A1 Dec. 19, 2013

Related U.S. Application Data

(60) Provisional application No. 61/661,330, filed on Jun. 18, 2012.

(51) Int. Cl.

| | |
|---|---|
| ***F21V 21/00*** | (2006.01) |
| ***F21V 29/00*** | (2015.01) |
| ***F21V 17/00*** | (2006.01) |
| ***F21V 7/04*** | (2006.01) |
| ***F21V 29/77*** | (2015.01) |
| *F21Y 101/02* | (2006.01) |

(52) U.S. Cl.

CPC ..... *F21V 29/22* (2013.01); *F21V 7/048* (2013.01); *F21V 17/00* (2013.01); *F21V 29/773* (2015.01); *F21Y 2101/02* (2013.01); *Y10T 29/49002* (2015.01)

(58) Field of Classification Search

CPC ..... F21V 2101/02; F21V 17/00; F21V 29/00; F21Y 2101/02

USPC ..... 362/235, 249.02, 294

See application file for complete search history.

(56) References Cited

U.S. PATENT DOCUMENTS

| | | | | |
|---|---|---|---|---|
| 7,874,696 | B2 * | 1/2011 | Engel | 362/147 |
| 8,596,811 | B2 * | 12/2013 | Trott et al. | 362/184 |
| 8,684,569 | B2 * | 4/2014 | Pickard et al. | 362/382 |
| 9,010,961 | B2 * | 4/2015 | Zhang et al. | 362/231 |
| 9,022,621 | B2 * | 5/2015 | Boyer et al. | 362/362 |
| 2010/0102199 | A1 * | 4/2010 | Negley et al. | 250/201.1 |
| 2010/0172144 | A1 * | 7/2010 | Liu | 362/373 |
| 2011/0069496 | A1 * | 3/2011 | Ing et al. | 362/311.02 |
| 2014/0376232 | A1 * | 12/2014 | Behr et al. | 362/294 |

* cited by examiner

*Primary Examiner* — Ali Alavi

(74) *Attorney, Agent, or Firm* — John M. Behles

(57) ABSTRACT

LED assemblies, lens-less luminaires, and methods of use are provided herein. According to some embodiments, the present technology may contemplate a lighting assembly that includes a reflector in association with a light emitting diode (LED) light source, the LED light source contacting a cooling device, wherein the LED light source is electrically coupled to a power source; and a mounting plate for coupling the lighting assembly to a luminaire.

20 Claims, 12 Drawing Sheets

FIG. 8A
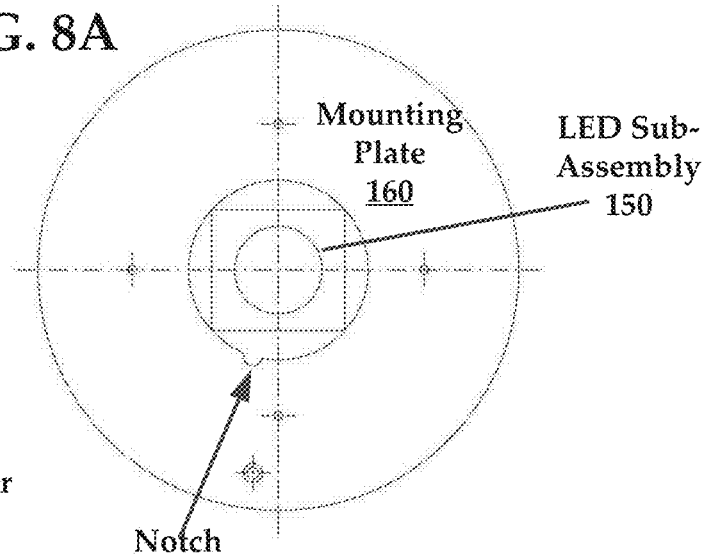
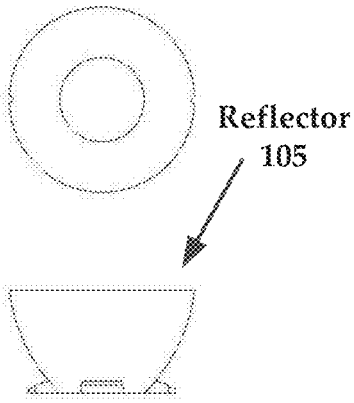
FIG. 8C
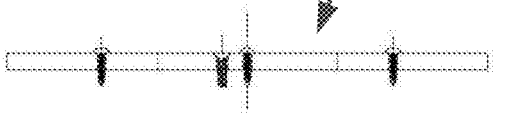
FIG. 8B

FIG. 11A
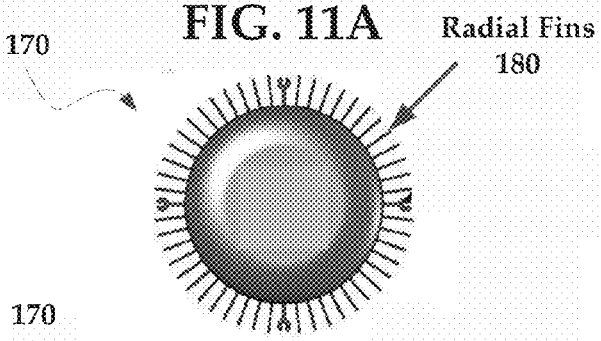
FIG. 11C
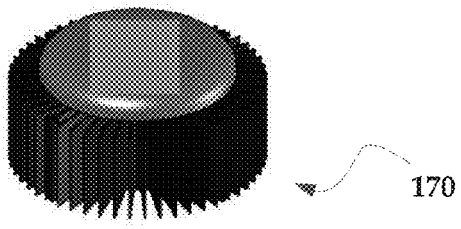
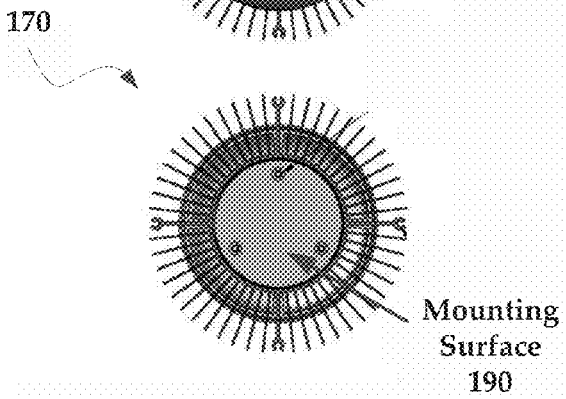
FIG. 11B
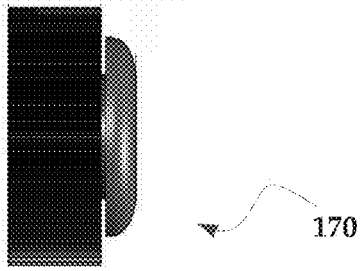
FIG. 11D

LIGHT EMITTING DIODE (LED) LIGHTING ASSEMBLIES AND METHODS OF USE

CROSS-REFERENCE TO RELATED APPLICATION(S)

This Non-Provisional U.S. patent application claims the priority benefit of U.S. Provisional Application Ser. No. 61/661,330, filed on Jun. 18, 2012, which is hereby incorporated by reference herein in its entirety including all references cited therein.

The present technology relates generally to light emitting diode (LED) lighting assemblies, and more specifically, but not by way of limitation, to LED lighting assemblies and lighting fixtures, such as luminaires, which incorporate the LED lighting assemblies of the present technology. Additionally, LED lighting assemblies of the present technology may be utilized to retrofit existing lighting fixtures that currently utilize inefficient lighting technology.

FIELD OF THE PRESENT TECHNOLOGY

The present technology relates generally to light emitting diode (LED) lighting assemblies, and more specifically, but not by way of limitation, to LED lighting assemblies and lighting fixtures, such as luminaires, which incorporate the LED lighting assemblies of the present technology. Additionally, LED lighting assemblies of the present technology may be utilized to retrofit existing lighting fixtures that currently utilize inefficient lighting technology.

BACKGROUND

Existing luminaires (e.g., light fixtures such as stage lights) utilize energy inefficient lighting sources. Commonly utilized lighting sources include high performance lamps (HPL), high-intensity discharge lamps (HID), as well as metal-halide lamps, fluorescents, incandescents, and so forth. While HID lamps provide some increase in energy efficiency relative to HPL lamps, both HID and HPL lamps require hundreds of watts of power to function at their designed output levels.

Moreover, these conventional lamp-type luminaires produce a significant amount of heat. It has been estimated that venues which utilize these conventional lamp luminaires, a significant portion of the operating expenses of the venue can be attributed to climate control processes (e.g., HVAC) to offset the heat produced by these conventional lamp luminaires. Thus, what is needed are LED lighting assemblies that can replace and/or be retrofit into conventional luminaires, such as stage lighting, (or other lighting assemblies) that reduce not only the amount of energy consumed, but also the heat produced by the luminaires. The present technology provides these benefits without deleteriously affecting the performance (e.g., lumen intensity) of the luminaires. Additionally, the present technology utilizes LED light sources which have a much longer operating life than standard filament light sources (e.g., HID and HPL lamps).

SUMMARY

According to some embodiments, the present technology may be directed to a lighting assembly having: (a) a reflector in association with (b) a light emitting diode (LED) light source, the LED light source contacting (c) a cooling device, wherein the LED light source is electrically coupled to (d) a power source; and (e) a mounting plate for coupling the lighting assembly to a luminaire.

According to some embodiments, the present technology may be directed to a lens-less luminaire having: (a) a housing assembly; and (b) a lighting assembly at least partially disposed within the housing assembly, the lighting assembly comprising: (i) a reflector in association with (ii) an LED light source, the LED light source contacting (iii) a cooling device, wherein the LED light source is electrically coupled to (iv) a power source, wherein the reflector replaces a lens of the standard luminaire; and (v) a mounting plate for coupling the lighting assembly to the housing assembly of the luminaire.

According to some embodiments, the present technology may be directed to a method that includes the steps of: (a) removing an existing lighting assembly from the luminaire; (b) replacing the existing lighting assembly with a light emitting diode (LED) lighting assembly that comprises: (i) a reflector in association with an LED light source, the LED light source contacting a cooling device, wherein the LED light source is electrically coupled to a power source; and (ii) a mounting plate for coupling the lighting assembly to the housing assembly of the luminaire.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

FIG. 8A is a top-down view of a portion of the exemplary lighting assembly, showing the Mounting Sub-Assembly and an LED Sub-Assembly.

FIG. 8B is an elevational view of the Mounting Sub-Assembly.

FIG. 8C is a front elevational view of the Reflector.

FIGS. 11A-D are various views of an exemplary Cooling Assembly (Heat Sink) for use in accordance with the present technology.

DETAILED DESCRIPTION OF EXEMPLARY EMBODIMENTS

Figure 1:
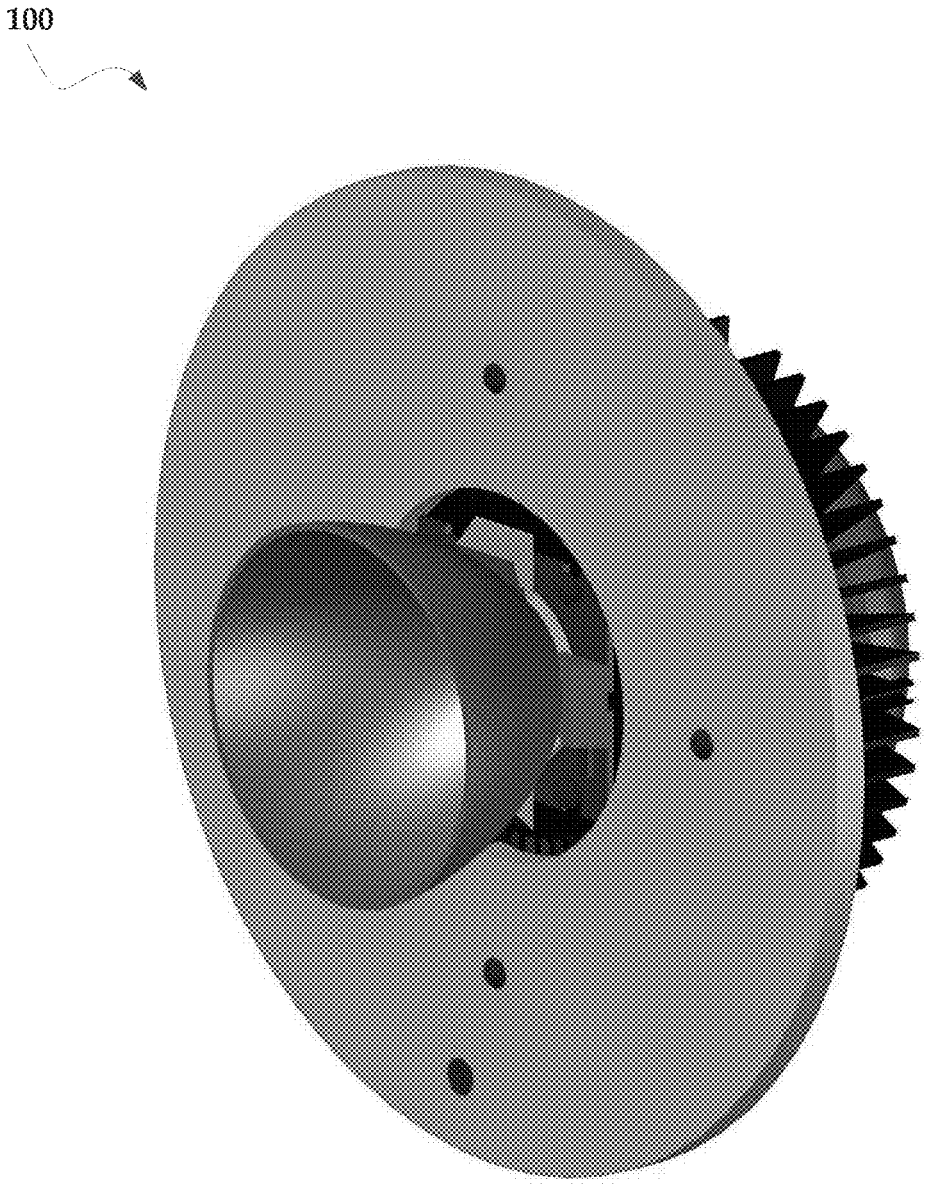
FIG. 1 is a front perspective view of an exemplary lighting assembly of the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Figure 2:
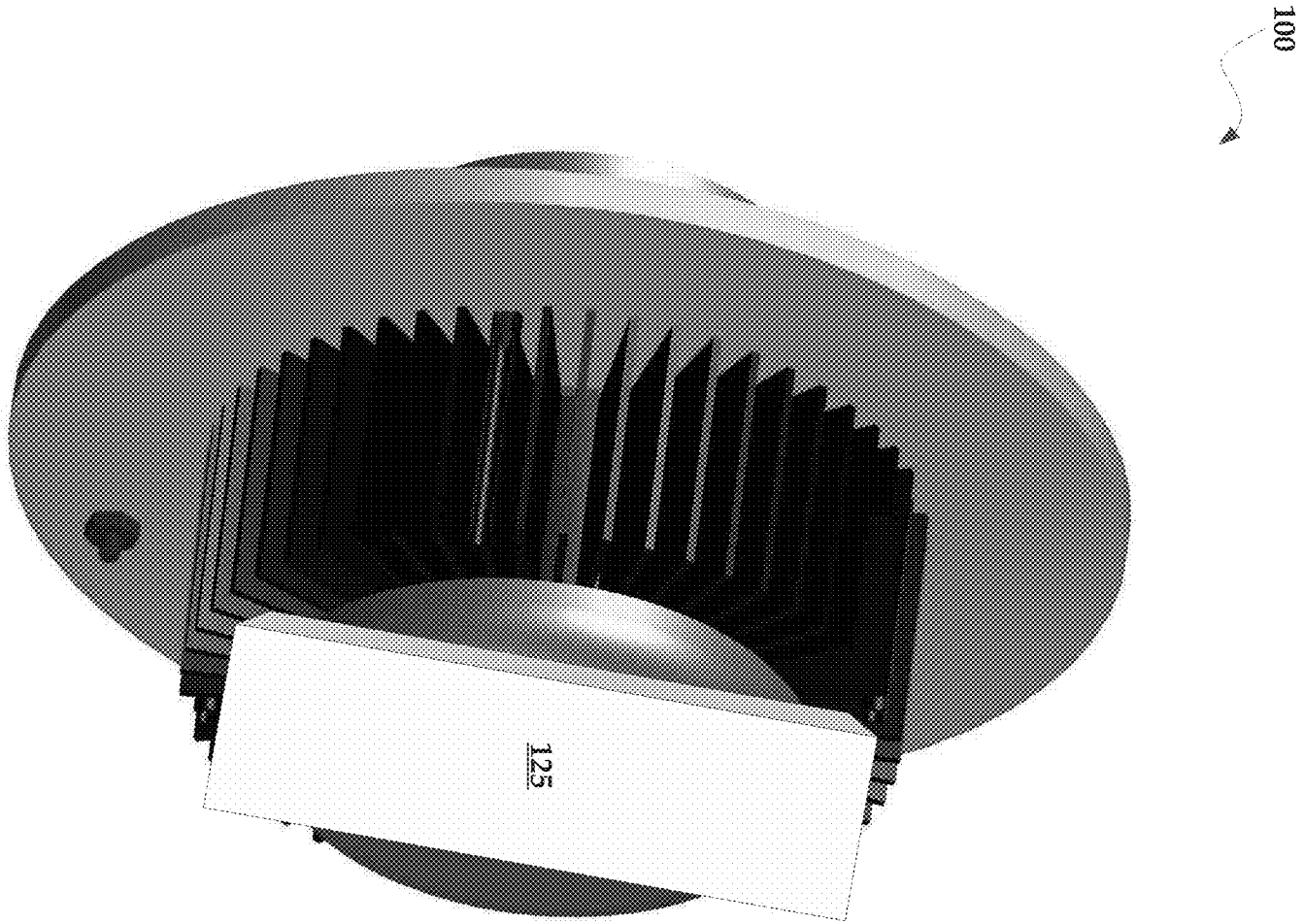
FIG. 2 is a rear perspective view of the exemplary lighting assembly of FIG. 1.

FIGS. 1 and 2 are perspective views of an exemplary lighting assembly, hereinafter "assembly 100" constructed in accordance with the present technology. Generally speaking, the assembly 100 may be utilized in luminaires (such as the luminaire of FIGS. 10A and 10B) to increase the energy efficiency of the luminaires and also to reduce the heat generated by the luminaires. In some instances, the assembly 100 may provide an increase in energy efficiency of approximately 600% relative to a conventional luminaire, such as a 575 Watt ETC Source Four® manufactured by Electronic Theater Controls, Inc. of Middleton, Wis.

Figure 3:
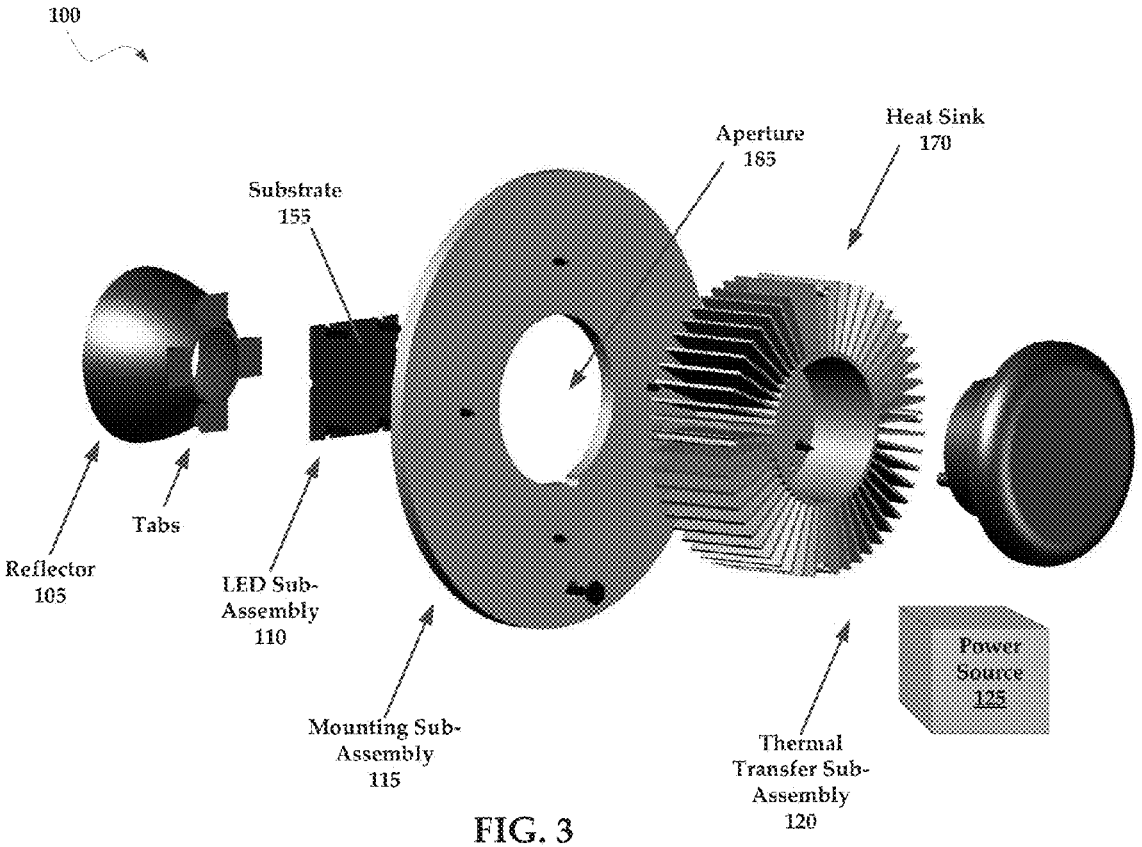
FIG. 3 is a partial exploded rear perspective view of the exemplary lighting assembly of FIGS. 1 and 2.
Figure 4:
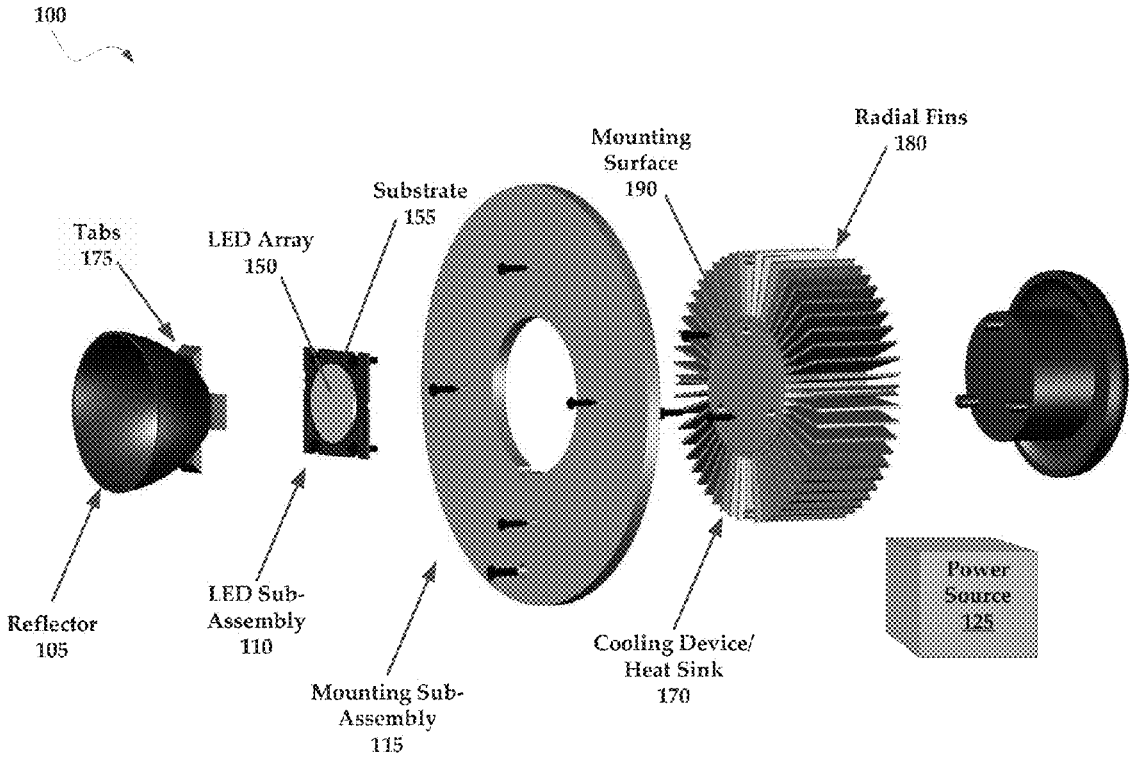
FIG. 4 is a partial exploded front perspective view of the exemplary lighting assembly of FIGS. 1-3.
Figure 5:
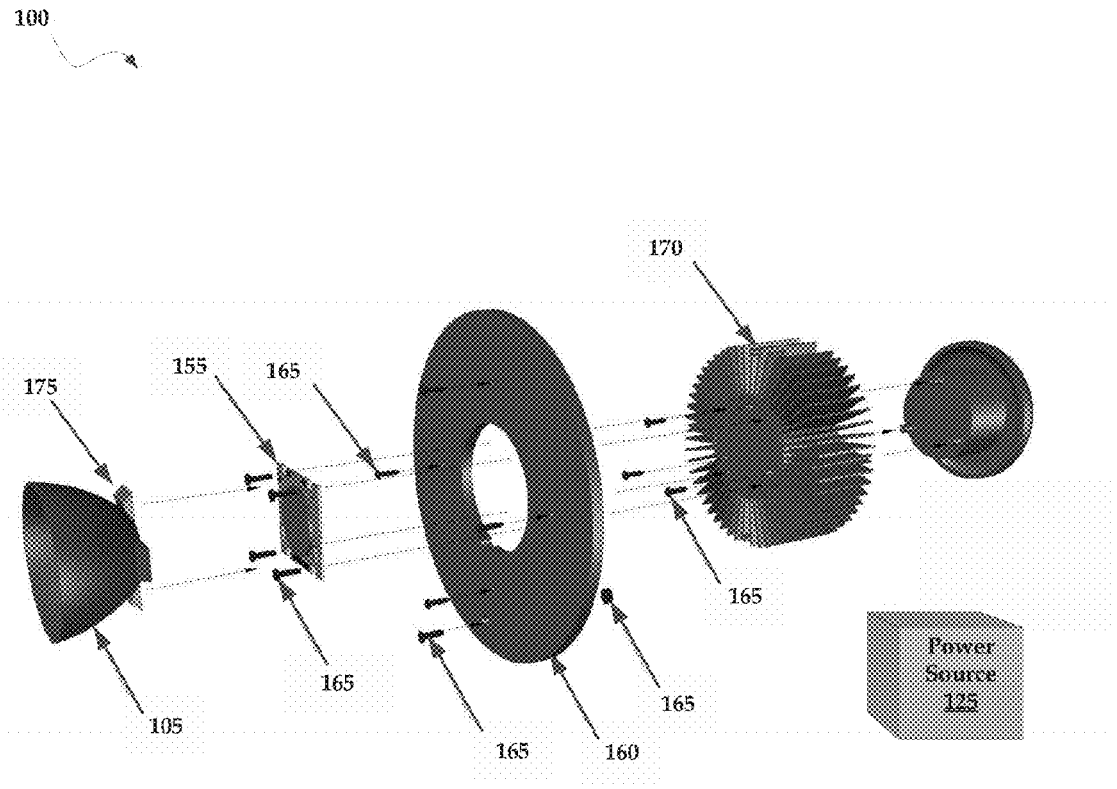
FIG. 5 is another exploded front perspective view of the exemplary lighting assembly of FIGS. 1-3, showing additional fasteners.

FIGS. 3 and 4 are exploded perspective views of the assembly 100 of FIGS. 1 and 2. According to some embodiments, the assembly 100 may comprise a Reflector 105, an LED Sub-Assembly 110, a Mounting Sub-Assembly 115, and/or a Thermal Transfer Sub-Assembly 120. It is noteworthy that the assembly 100 may comprise fewer or more components than those illustrated. FIG. 5 is an alternate exploded perspective view of the exemplary lighting assembly of FIGS. 1-4.

According to some embodiments, the assembly 100 comprises an LED Sub-Assembly 110, which in some embodiments comprises an LED Array 150 that is disposed on a Substrate 155. The Substrate 155 may comprise any commonly known substrate material that may be selected for its supportive, conductive, and/or insulating properties. Exemplary substrates may comprise fiberglass-filled epoxies, ceramics, and/or insulated metals.

In other embodiments, the LED Array 150 may comprise only a single LED light. In other embodiments, the LED Array 150 may comprise a plurality of LED lights arranged onto the Substrate 155 according to a predetermined pattern. Advantageously, each of the LED lights may have a substantially flat shape, although other LED light shapes such as round, pear, funnel, tubular, rope, domed, and so forth are also contemplated for use in accordance with the present technology. Advantageously, the LED lights of the LED Array 150 may all produce the same amount of light (e.g. lumens), or may produce differing amounts of light relative to one another.

Figure 6C:
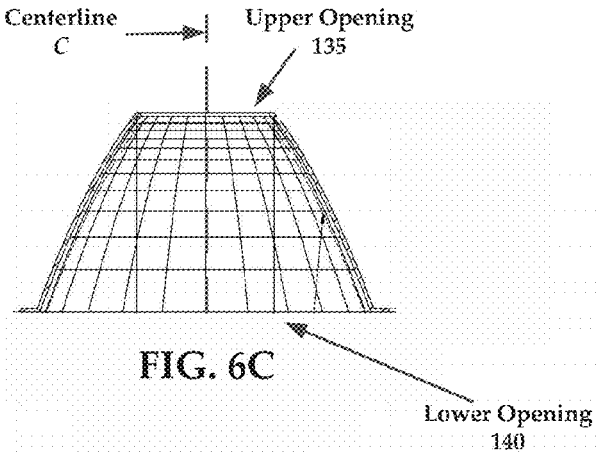
FIG. 6C is a cross-sectional view of the Reflector taken along line A-A of FIG. 6B.
Figure 6B:
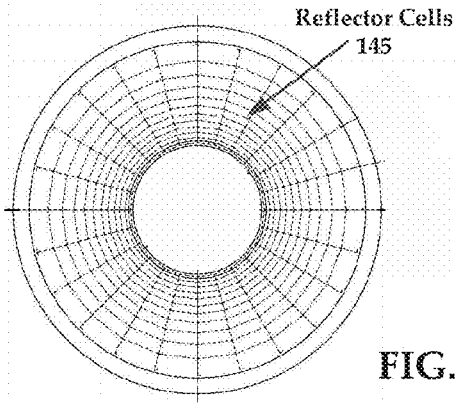
FIG. 6B is a bottom-up view of the Reflector.
Figure 6A:
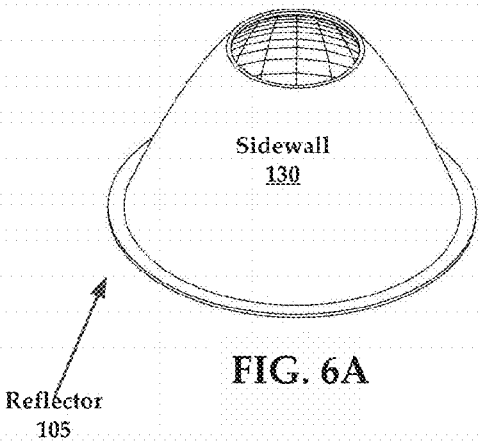
FIG. 6A is a perspective view of a Reflector.
Figure 7:
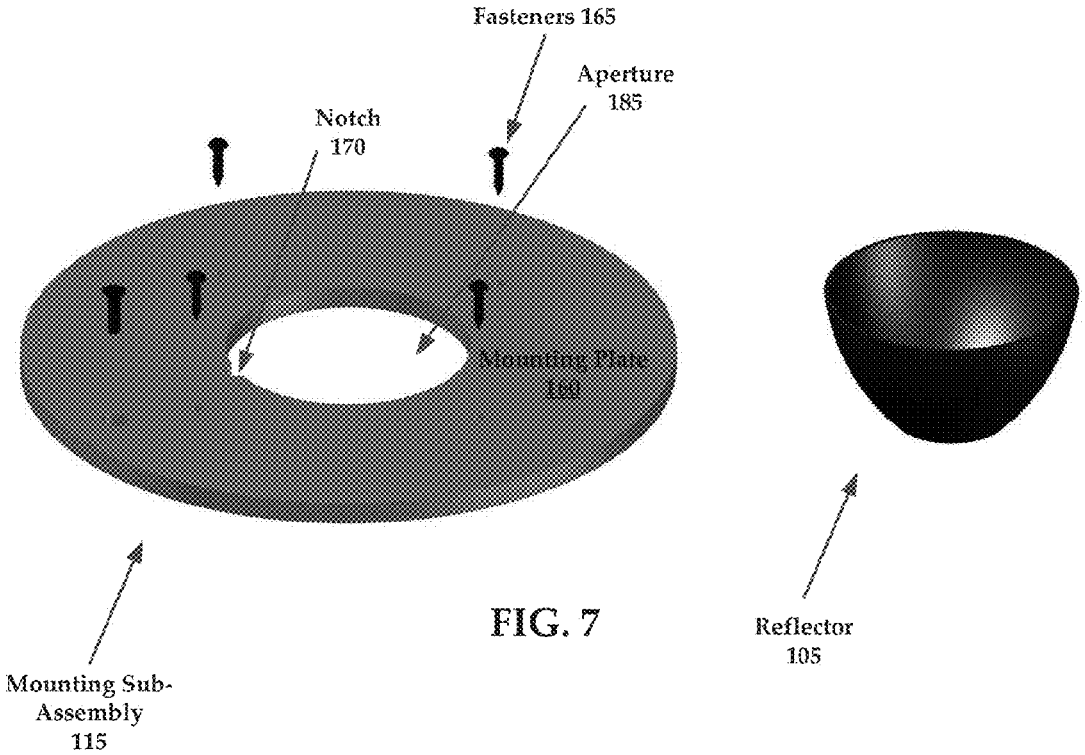
FIG. 7 includes perspective views of a Mounting Sub-Assembly and a Reflector.

FIGS. 6A-C collectively illustrate an exemplary embodiment of a Reflector 105 for use in accordance with the present technology. In some instances, the Reflector 105 may be constructed of a plastic, polymeric, or resin-based material, although other materials that would be known to one of ordinary skill in the art are likewise contemplated for use in accordance with the present technology. In accordance with the present disclosure, the Reflector 105 is shown as having a substantially frustoconical shape. Additionally, a Sidewall 130 of the Reflector 105 is shown as being slightly arcuate such that the Reflector 105 flares outwardly from an Upper Opening 135 to a Lower Opening 140. It will be understood that the exact shape and dimensions of the Reflector 105 may vary according to design requirements such as the configuration of the LED array (or LED light). Advantageously, variations in the size and/or shape of the Reflector 105 may affect the shape of the beam of light that is directed outwardly from the Reflector 105. For example, as the diameter of the Lower Opening 140 increases, the width of the beam of light emanating from the Reflector 105 increases.

According to some embodiments, the Reflector 105 comprises a Sidewall 130 that flares outwardly and frusto-conically from an Upper Opening 135 to a Lower Opening 140 thereof.

Additionally, the Reflector 105 is shown as comprising a plurality of Reflector Cells 145 that are disposed on the inner surface of the Sidewall 130. It is noteworthy to mention that the shape and size of the individual Reflector Cells 145 may vary along the length of the Reflector 105. For example, Reflector Cells 145 disposed near the Upper Opening 135 may be smaller relative to the Reflector Cells 145 disposed proximate the Lower Opening 140 of the Reflector 105. In operation, the layout of the Reflector Cells 145, along with the geometrical configuration of the inner surface of the Reflector 105, determine how light that is generated by the LED Array 150 (FIG. 4) will be focused into a beam. Thus, the width of the beam of light produced by an exemplary assembly may directly relate to the shape and size of not only the Reflector 105 in general, but specifically to the sizing and arrangement of Reflector Cells 145 within the body of the Reflector 105.

Referring back to FIGS. 2 and 3, the Reflector 105 is shown as also comprising a plurality of Tabs 175 that extend from the Upper Opening 135 of the Reflector 105. More specifically, the plurality of Tabs 175 may extend from a peripheral edge of the Upper Opening 135. Each of the plurality of Tabs 175 is shown as extending substantially normally to the Upper Opening (also relative to a Centerline C of the Reflector 105 as shown in FIG. 6C). The plurality of Tabs 175 may be utilized to associate and/or join the Reflector 105 to the Substrate 155 of the LED Sub-Assembly 110. In some embodiments, the Upper Opening 135 of the Reflector 105 encircles the LED Array 150.

FIGS. 7 and 8A-C collectively illustrate various views of the Mounting Sub-Assembly 115 and the Reflector 105 of the assembly 100. The Mounting Sub-Assembly 115 is shown as comprising a Mounting Plate 160 having a substantially annular shape, along with a plurality of Fasteners 165. According to some embodiments, the Mounting Plate 160 may be sized to be matingly received within a housing assembly of a standard luminaire (see FIGS. 10A-B), as will be discussed in greater detail infra. As best illustrated in FIG. 8A, the Mounting Plate 160 is shown as comprising a Notch 195 that allows for electrical wiring (not shown) that electrically couples the LED Array 150 with the Power Source 125 (see FIGS. 2, 4, and 5) to pass through the Mounting Plate 160. The Mounting Plate 160 may comprise an Aperture 185 that is sized to receive at least a portion of a Heat Sink 170, as will be described in greater detail below.

Figure 9A:
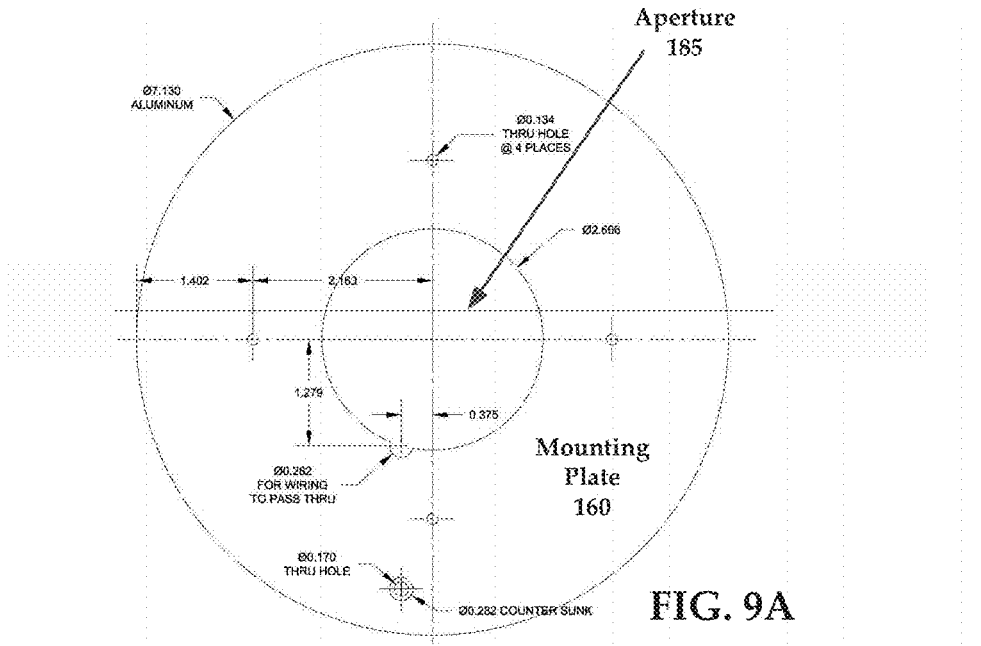
FIG. 9A is a top-down view of a Mounting Plate of the Mounting Sub-Assembly.
Figure 9B:
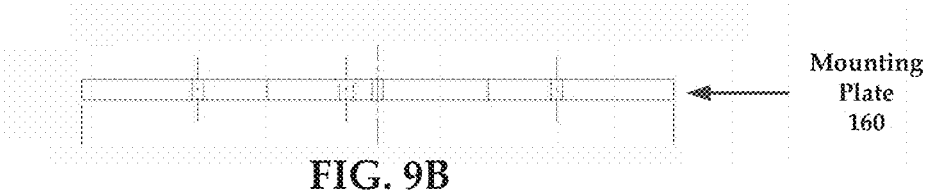
FIG. 9B is an elevational view of the Mounting Plate of the Mounting Sub-Assembly.

FIGS. 9A and 9B are alternative views of the Mounting Plate 160, providing additional dimensional details regarding some embodiments of the Mounting Sub-Assembly 110. It is noteworthy that the dimensions of FIGS. 9A-B are merely exemplary and are thus not limiting in any way.

As mentioned briefly above, electrical wiring (not shown) may be utilized to electrically couple the LED Array 150 to the Power Source directly. In some instances, the LED Array 150 may be electrically coupled to the Substrate 155 such that the LED Array is indirectly electrically coupled to the Power Source via the Substrate 155. Also, it is noteworthy that the Power Source 125 may be mounted to the Thermal Transfer Sub-Assembly 120 in some instances.

The Thermal Transfer Sub-Assembly 120 may, in some embodiments, include a Heat Sink 170 (also known as a "cooling device 170"). According to some embodiments, the Heat Sink 170 may comprise a body portion and a plurality of fins 180 that extend radially from the body portion. In some instances the Heat Sink 170 may comprise a Mounting Surface 190 that mates with the Aperture 185 of the Mounting Plate 160. In some embodiments, the Substrate 155 of the LED Sub-Assembly 110 is attached to the Mounting Surface 190 of the Heat Sink 170.

In some instances, the Power Source 125 may be disposed behind the Thermal Transfer Sub-Assembly 120. As already mentioned previously, the Power Source 125 may be preferably electrically coupled with the LED Array 150 of the LED Sub-Assembly 110 either directly or indirectly. The Power Source 125 may comprise any type of power generating, converting, and/or delivery device that is designed to provide power to a lighting unit such as an LED Array 150.

Figure 10A:
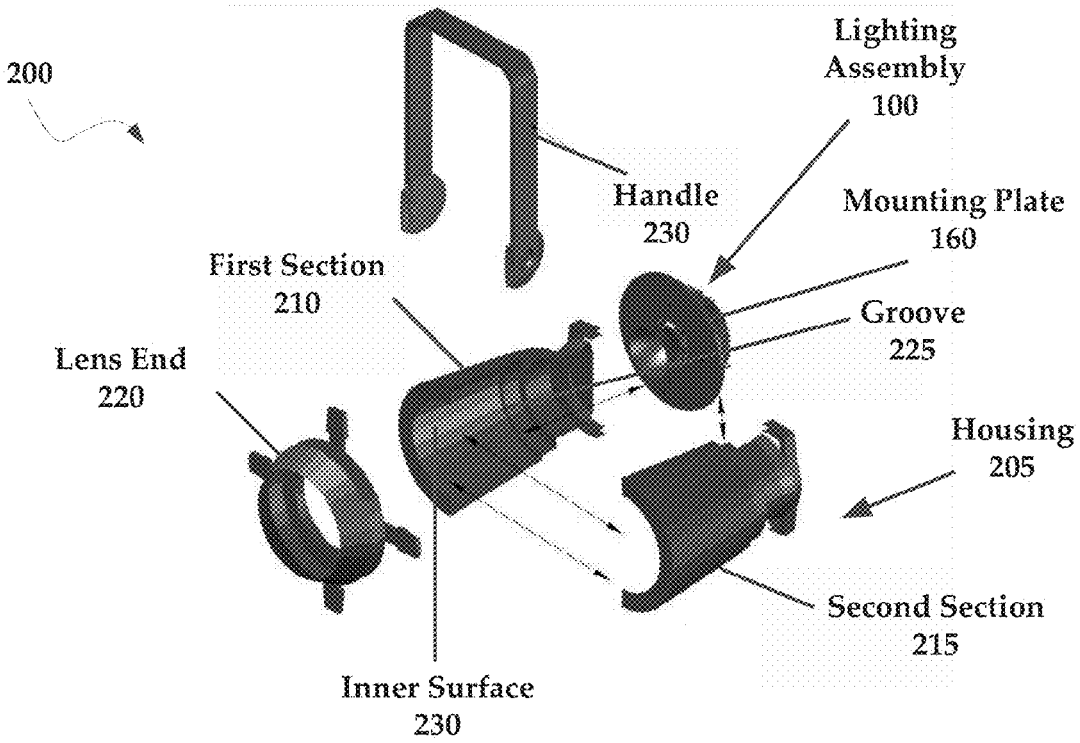
FIGS. 10A-B, collectively, illustrate an exemplary process for retrofitting a conventional luminaire with an exemplary lighting assembly of the present technology.
Figure 10B:
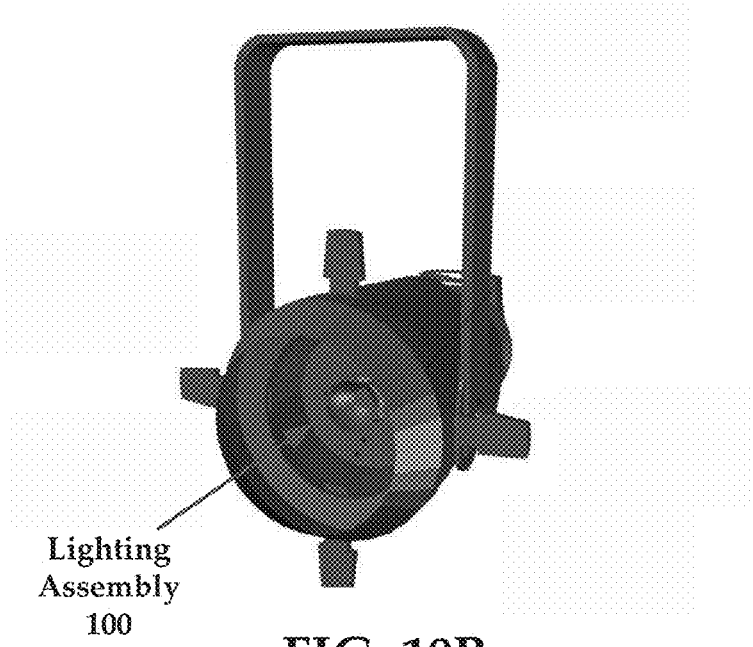

FIGS. 10A-B illustrate a process for retrofitting a standard luminaire such as a 575 Watt ETC Source Four® stage light 200 manufactured by Electronic Theater Controls, Inc. Initially, a handle 230 of the stage light ("luminaire 200") is removed. Next, fasteners that join two sections of the housing 205 assembly of the luminaire 200 are removed to allow the two sections 210 and 215 of the housing 205 to be separated from one another. Additionally, the lens end 220 of the luminaire 200 is also removed from the end of the housing 205. While not shown, the standard HID or HPL lamp assembly may be removed from within the housing assembly. The standard lamp assembly may comprise a lamp, a heat transfer unit (such as a heat sink), and a power source. In some instances, the existing lighting assembly of the luminaire 200 comprises any of a high intensity discharge lamp, a high performance lamp, an incandescent lamp, a halogen lamp, a fluorescent lamp, and combinations thereof.

Once the luminaire 200 has been disassembled and the standard lamp assembly removed, an exemplary lighting assembly 100 constructed in accordance with the present technology may be installed within the housing 205. The exemplary lighting assembly may be installed by fitting the edge of the Mounting Plate 160 within a groove 225 of the housing 205 of the luminaire 200. Note that the edge of the Mounting Plate 160 may contact an inner surface 230 of the housing 205 of the luminaire 200. In some instances, the Mounting Plate 160 may be sized to fit within an existing track/channel (see groove 225) fabricated into the inner surface of the housing 205. Fasteners, adhesives, and/or other securing means may be utilized to affix the lighting assembly within the housing 205. In other embodiments, when the two sections 210 and 215 of the housing 205 are secured together, the two sections 210 and 215 may exert compressive forces on the Mounting Plate 160 to secure the lighting assembly 100 within the housing 205. It is noteworthy that the Reflector 105 of the assembly 100 may be completely covered by the housing 205 to ensure that light emitted by the LED Array 150 is directed towards and through the lens end 220 of the luminaire 200.

To reassemble the housing 205, the two sections 210 and 215 of the housing 205 are joined together via fasteners. Also, the lens end 220 and handle 230 are re-secured to the housing 205 of the luminaire, as shown in FIG. 10B.

It will be understood that while FIGS. 10A and B illustrate the use of a lens end 220, advantageously, the use of a Reflector 105 allows for the creation of luminaires that do not require the use of a lens. That is, all standard luminaires require the use of a lens to properly focus light that is emitted from the existing lighting assembly, otherwise, the light emitted from the existing lighting assembly would diffuse in a completely unusable manner. To change the focus or light dispersal pattern of the luminaire, the user may interchange the lens of the luminaire. For example, if the user desires a natural light effect or a spotlight effect, two separate lenses are required to produce these different effects.

Lenses are costly and interchanging lenses is a difficult process since most luminaires are suspended high above the ground. The use of a reflector in place of a lens is a cost effective modification to an existing (or new) luminaire. Also, the process of exchanging reflectors, rather than lenses, is a much safer process, which does not require the presence of multiple operators or users. An exemplary lens-free luminaire could be created from retrofitting a standard luminaire, such as the standard luminaire shown in FIG. 10A, where the Lens End 220 is removed and discarded, rather than being replaced as shown in FIG. 10B. The removal of the lens from the luminaire allows for luminaires of varying size and shape to be created. That is, since the lens end was a requirement of a standard luminaire, and such lenses were necessarily round to effectuate their desired light focusing function, standard luminaires have accommodating round shaped housing assemblies.

Figure 12A:
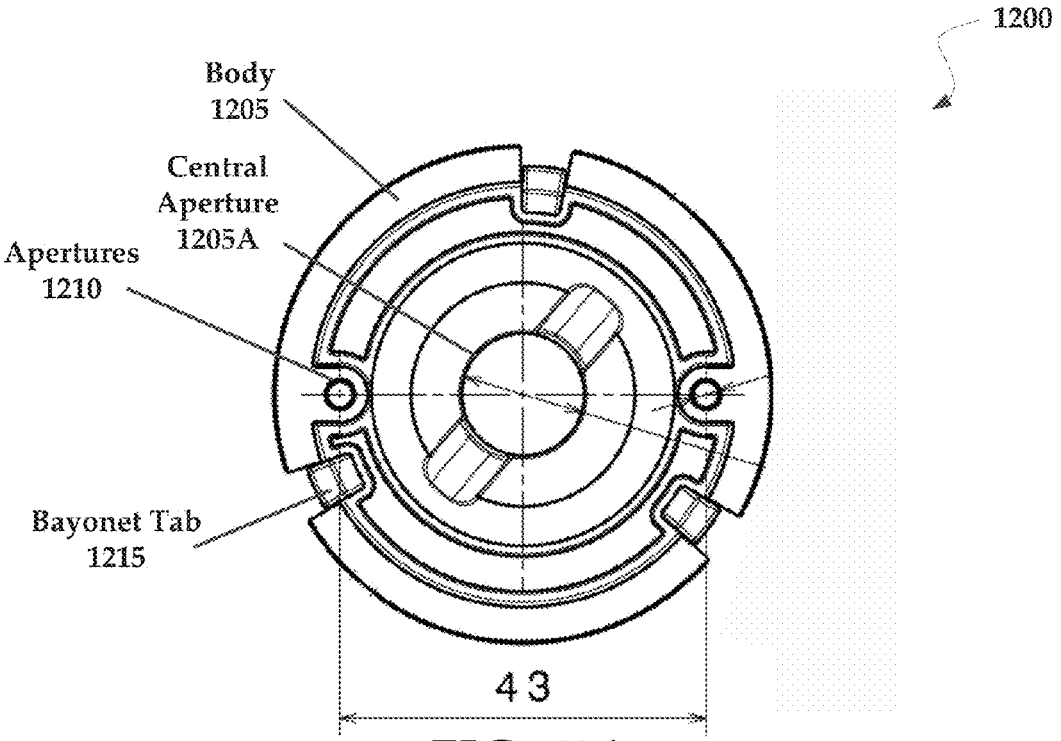
FIG. 12A is an exemplary mounting bracket that accommodates various reflectors which are utilized in accordance with the present technology.
Figure 12B:
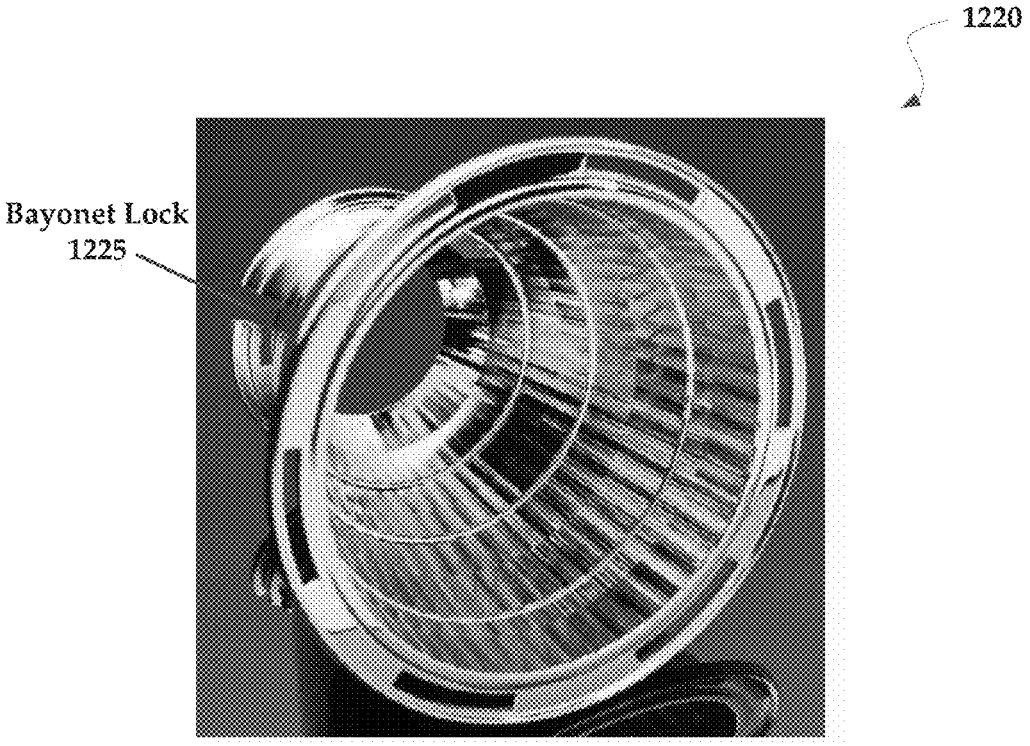
FIG. 12B is an exemplary reflector that is configured to mate with the mounting bracket of FIG. 12A.

FIGS. 12A and B illustrate the use of a Mounting bracket 1200 that allows for quick removal and replacement of reflectors, such as the Reflector 1220 of FIG. 12B. More specifically, the Mounting bracket 1200 comprises a Body 1205 that includes a cylindrical disk having a particular thickness. The Body 1205 includes a Central Aperture 1205A that is sized to receive an LED array or light, such as the LED Array 150 of FIGS. 3 and 4.

The body 1205 also includes apertures 1210 that accommodate fasteners such as screws. These fasteners are used to join the mounting bracket 1200 to the Substrate 155 of the LED Sub-Assembly 110 (See FIGS. 3 and 4). Thus, the mounting bracket 1200, when installed, is disposed between the Reflector 105 and the Substrate 155.

To provide a quick means for attaching and detaching various reflectors, the mounting bracket 1200 comprises a plurality of Bayonet Tabs, such as Bayonet Tab 1215. The Bayonet Tab 1215 may comprise a protrusion that extends upwardly from Body 1205. The Bayonet Tab 1215 is configured to lockingly engage with a Bayonet Lock 1225 (groove) that is fabricated into the base of an exemplary Reflector 1220.

Therefore, in some embodiments, the present technology contemplates the creation of a lens-free luminaire that comprises an exemplary lighting assembly, as described above. These lens-free luminaires can be created from standard luminaires that have been retrofitted with an exemplary lighting assembly of the present technology, or also luminaires which are initially manufactured with an exemplary lighting assembly of the present technology.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A lighting assembly, comprising:

a reflector in association with a light emitting diode (LED) light source, the LED light source contacting a cooling device, wherein the LED light source is electrically coupled to a power source; and a mounting plate for coupling the lighting assembly to a luminaire.

2. The lighting assembly according to claim 1, wherein the reflector comprises a sidewall that flares outwardly and frusto-conically from an upper opening to a lower opening.

3. The lighting assembly according to claim 2, wherein the reflector includes a plurality of tabs that extend laterally from a peripheral edge of the upper opening.

4. The lighting assembly according to claim 3, wherein the LED light source comprises an array of LED lights that are disposed on a substrate, wherein the upper opening of the reflector encircles the array of LED lights, wherein the plurality of tabs are secured to the substrate of the reflector.

5. The lighting assembly according to claim 4, wherein the mounting plate is an annular plate having an inner aperture that is sized to receive a Mounting Surface of the cooling device such that the Mounting Surface mates with the inner aperture.

6. The lighting assembly according to claim 5, wherein the cooling device further comprises a plurality of radially extending fins that form a heat sink.

7. The lighting assembly according to claim 6, wherein the substrate is attached to the Mounting Surface of the cooling device.

8. The lighting assembly according to claim 7, wherein the mounting plate comprises a notch within the inner aperture that is configured to provide a path for electrical wiring that electrically couples the array of LED lights to the power source.

9. A lens-less luminaire, comprising:

a housing assembly; and a lighting assembly at least partially disposed within the housing assembly, the lighting assembly comprising:

a reflector in association with an LED light source, the LED light source contacting a cooling device, wherein the LED light source is electrically coupled to a power source, wherein the reflector replaces a lens of the standard luminaire; and a mounting plate for coupling the lighting assembly to the housing assembly of the luminaire.

10. The luminaire according to claim 9, wherein the reflector comprises a sidewall that flares outwardly and frusto-conically from an upper opening to a lower opening, further wherein the reflector includes a plurality of tabs that extend laterally from a peripheral edge of the upper opening.

11. The luminaire according to claim 10, wherein the LED light source comprises an array of LED lights that are disposed on a substrate, wherein the upper opening of the reflector encircles the array of LED lights, wherein the plurality of tabs are secured to the substrate of the reflector, and wherein the mounting plate is an annular plate having an inner aperture that is sized to receive a Mounting Surface of the cooling device such that the Mounting Surface mates with the inner aperture.

12. The luminaire according to claim 11, wherein the luminaire having the LED light source is configured to have an operating efficacy of around 115 lumens per watt of energy consumed.

13. A method for improving energy efficiency of a luminaire, the method comprising:

removing an existing lighting assembly from the luminaire; and replacing the existing lighting assembly with a light emitting diode (LED) lighting assembly that comprises:

a reflector in association with an LED light source, the LED light source contacting a cooling device, wherein the LED light source is electrically coupled to a power source; and a mounting plate for coupling the lighting assembly to the housing assembly of the luminaire.

14. The method according to claim 13, wherein the existing lighting assembly comprises any of a high intensity discharge lamp, a high performance lamp, an incandescent lamp, a halogen lamp, a fluorescent lamp, and combinations thereof.

15. The method according to claim 13, further comprising separating a housing of the luminaire into two sections thereby exposing the existing lighting assembly.

16. The method according to claim 15, further comprising disposing the LED lighting assembly within the housing such that an outer edge of the mounting plate contacts a groove that extends circumferentially around an inner surface of the housing.

17. The method according to claim 13, wherein the reflector is disposed entirely within the housing assembly of the luminaire after replacing the existing lighting assembly with the LED lighting assembly.

18. The method according to claim 13, wherein the reflector comprises a sidewall that flares outwardly and frusto-conically from an upper opening to a lower opening, further wherein the reflector includes a plurality of tabs that extend laterally from a peripheral edge of the upper opening.

19. The method according to claim 18, wherein the LED light source comprises an array of LED lights that are disposed on a substrate, wherein the upper opening of the reflector encircles the array of LED lights, wherein the plurality of tabs are secured to the substrate of the reflector, and wherein the mounting plate is an annular plate having an inner aperture that is sized to receive a Mounting Surface of the cooling device such that the Mounting Surface mates with the inner aperture.

20. The method according to claim 13, wherein replacement of the existing lighting assembly with the LED lighting assembly produces a luminaire having an operating efficacy of around 115 lumens per watt of energy consumed.

* * * * *